US007414217B2

(12) United States Patent
Fitzgibbons et al.

(10) Patent No.: US 7,414,217 B2
(45) Date of Patent: Aug. 19, 2008

(54) SORTING SYSTEM

(75) Inventors: Patrick J. Fitzgibbons, Newark Valley, NY (US); Bruce H. Hanson, Endicott, NY (US); Michael D. Senger, Endicott, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 99 days.

(21) Appl. No.: 10/624,866

(22) Filed: Jul. 22, 2003

(65) Prior Publication Data

US 2004/0138778 A1 Jul. 15, 2004

Related U.S. Application Data

(63) Continuation-in-part of application No. 10/116,078, filed on Apr. 4, 2002, now abandoned.

(60) Provisional application No. 60/302,877, filed on Jul. 2, 2001.

(51) Int. Cl.
*B07C 5/00* (2006.01)

(52) U.S. Cl. ..... 209/584; 209/900; 700/224

(58) Field of Classification Search ..... 209/584, 209/900, 702, 703, 942; 700/223, 224
See application file for complete search history.

(56) References Cited

U.S. PATENT DOCUMENTS

| | | | |
|---|---|---|---|
| 3,880,298 | A | 4/1975 | Habegger et al. |
| 3,929,076 | A | 12/1975 | McRae, Jr. et al. |
| 3,941,372 | A | 3/1976 | Matsuo |
| 4,181,947 | A | 1/1980 | Krauss et al. |
| 4,401,301 | A | 8/1983 | Hayskar |
| 4,440,492 | A | 4/1984 | Howard |
| 4,566,595 | A | 1/1986 | Fustier |
| 4,630,216 | A | 12/1986 | Tyler et al. |
| 4,641,753 | A | 2/1987 | Tamada |
| 4,672,553 | A | 6/1987 | Goldberg |
| 4,690,751 | A | 9/1987 | Umiker |
| 4,974,721 | A | 12/1990 | Born |
| 5,009,321 | A | 4/1991 | Keough |
| 5,031,223 | A | 7/1991 | Rosenbaum et al. |
| 5,072,822 | A | 12/1991 | Smith |
| 5,074,539 | A | 12/1991 | Wells et al. |
| 5,133,543 | A | 7/1992 | Eitel et al. |
| 5,226,547 | A | 7/1993 | Malatesta |
| 5,289,983 | A | 3/1994 | Ueda et al. |

(Continued)

FOREIGN PATENT DOCUMENTS

| | | | |
|---|---|---|---|
| EP | 0575109 | A1 | 12/1993 |

(Continued)

*Primary Examiner*—Patrick Mackey
*Assistant Examiner*—Mark Hageman
(74) *Attorney, Agent, or Firm*—Wolf, Greenfield & Sacks, P.C.

(57) ABSTRACT

A system and method are provided for sorting a plurality of items into a predetermined sorted sequence. Items are initially located on initial sorting regions of a sorting apparatus. The items are then sorted into at least one intermediary sorted set and then sorted, from the intermediary sorted sets, into the final sorted sequence. A computer may be used to track the position of the items on the sorting apparatus and to control the movement of the items into the sorted sequence.

12 Claims, 9 Drawing Sheets

U.S. PATENT DOCUMENTS

| | | | | |
|---|---|---|---|---|
| 5,353,915 | A | 10/1994 | Schneider | |
| 5,398,922 | A | 3/1995 | Malatesta | |
| 5,544,758 | A | 8/1996 | Malatesta | |
| 5,706,928 | A | 1/1998 | Neukam | |
| 6,059,091 | A | 5/2000 | Maier et al. | |
| 6,270,069 | B1 | 8/2001 | Cera et al. | |
| 6,316,741 | B1 * | 11/2001 | Fitzgibbons et al. | 209/584 |
| 6,328,302 | B2 * | 12/2001 | Hendrickson et al. | 271/207 |
| 6,598,748 | B2 * | 7/2003 | Mileaf et al. | 209/542 |
| 6,921,875 | B2 * | 7/2005 | Hanson | 209/583 |
| 6,924,451 | B2 * | 8/2005 | Hanson | 209/584 |
| 6,946,612 | B2 * | 9/2005 | Morikawa | 209/584 |
| 7,012,211 | B2 * | 3/2006 | Brinkley et al. | 209/584 |
| 7,112,756 | B2 * | 9/2006 | Hanson | 209/584 |

FOREIGN PATENT DOCUMENTS

| | | |
|---|---|---|
| WO | WO 98/24564 A1 | 6/1998 |

* cited by examiner

SORTING SYSTEM

RELATED APPLICATIONS

This application is a continuation-in-part application of application Ser. No. 10/116,078 filed Apr. 4, 2002, and entitled "SORTING SYSTEM," by Patrick J. Fitzgibbons, Bruce H. Hanson and Michael D. Senger.

FIELD OF THE INVENTION

This application pertains to sorting of items, and in particular to using a single pass algorithm to sort unordered items located in different areas into one stream.

BACKGROUND

There are numerous industry and other applications that require sorting of unordered items into a stream or an ordered arrangement based on a particular sorting order. Prior to sorting, the items to be sorted might be located not only in random order, but also on physically different structures, for example, on different conveyors. Typically, the items must not only be sorted locally on each conveyor, but must also be globally sorted over all the conveyors.

A computer system is sometimes used to automate the entire sorting process, or at least a portion of it, by deciding how to move the items. In order to electronically keep track of the items, some systems use bar codes or other computer-readable labels on the items. However, the items may be of different sizes, weight and materials, such that labels may not be appropriate. Labeling might also be prohibitive for other reasons, such as cost and time requirements. Additionally, labeling of items may hinder reuse of items in subsequent sorting procedures, as previous labels may have to be removed before application of new labels. Likewise, other devices for identifying locations of different items during a sorting process may not be convenient for certain applications.

A need therefore exists for a computerized system that will automate the sorting process while being able to combine items from several unsorted conveyors or streams into a single sorted output and keeping track of the items without additional labels or sensing devices. Furthermore, such a system should sort the items efficiently, optimally requiring only a single pass to sort all items.

Delivering, shipping, and storing mail items are a few, but by far not the only applications where such sorting systems are needed. Mail items must be sorted and resorted at several points in their progress. For example, at the destination post office, they need to be sorted into separate groups corresponding to an actual mail route. While there might be a mail sorting machine sorting individual pieces of mail into bins according to group assignments, some groups might be too large to fit into a single bin, and each of those "oversized" groups will be assigned to multiple bins. As a result, while the items are arranged in some order inside the bins, the bins themselves might be out of order. If the mail sorting machines leave the bins in different physical locations, then there is an additional task of sorting and combining the bins themselves such that they are returned to a desired location, serially and in order. The bins may be of different sizes, and labeling them is inconvenient because they are reused every time mail needs to be sorted. Also, bins might have a different groups assigned to them depending on the particulars of the mail sort, thus requiring relabeling prior to the sort. Therefore, an apparatus is needed that is capable of automatically sorting bins located on different conveyors without the bins themselves being externally labeled and returning these bins serially and in the desired order to an operator or a downstream processing system.

SUMMARY

A system and method are provided for sorting a plurality of items into a predetermined sorted sequence. Each of the plurality of items is assigned a sequence number and are initially located in at least one initial sorting region. The items are sorted using a plurality of sorting regions. These sorting regions may include at least one initial region and at least two additional regions. One or more of the additional regions may also function as a return region.

The method comprises sorting the items of each initial region into an intermediary sorted set by moving, with mechanical mechanisms, at least some of the items between the initial regions and the additional regions. The mechanical mechanisms may also move items to different positions within each of the sorting regions.

The method further comprises using mechanical mechanisms to move and sort items from the intermediary sorted set to a return region in substantially the predetermined sorted sequence.

In one embodiment, a computer may be used to track the position of each item in the sorting regions. The computer may also be used to control the movement and positioning of the items.

In another embodiment, items in the return regions may be conveyed serially and in the sorted sequence.

In yet another embodiment, an identifier may be placed with each item. The identifier may be checked to ensure that the items are in the predetermined sorted sequence.

In one embodiment, the items may be positioned linearly in the sorting regions.

An apparatus is provided for sorting the items. The apparatus includes a plurality of sorting regions, a first mechanism for moving items between sorting regions, a second mechanism for moving items within each sorting region, an item location tracking mechanism, and controls for controlling the first and second mechanisms to move the items into a sorted sequence at least partly in response to the tracking mechanism.

In one embodiment, the sorting regions are one under another, and the first mechanism includes an elevator.

The second mechanism may include a conveyor.

In one embodiment, the controls include a processor running a subroutine for issuing instructions according to an item sorting algorithm.

In another embodiment, the items are postal bins.

In yet another embodiment, the sorting regions include at least one initial region, at least one return region, and at least one additional region.

The structure and operation of various embodiments of the present invention are described in detail below with reference to the accompanying drawings.

DETAILED DESCRIPTION

Figure 1:
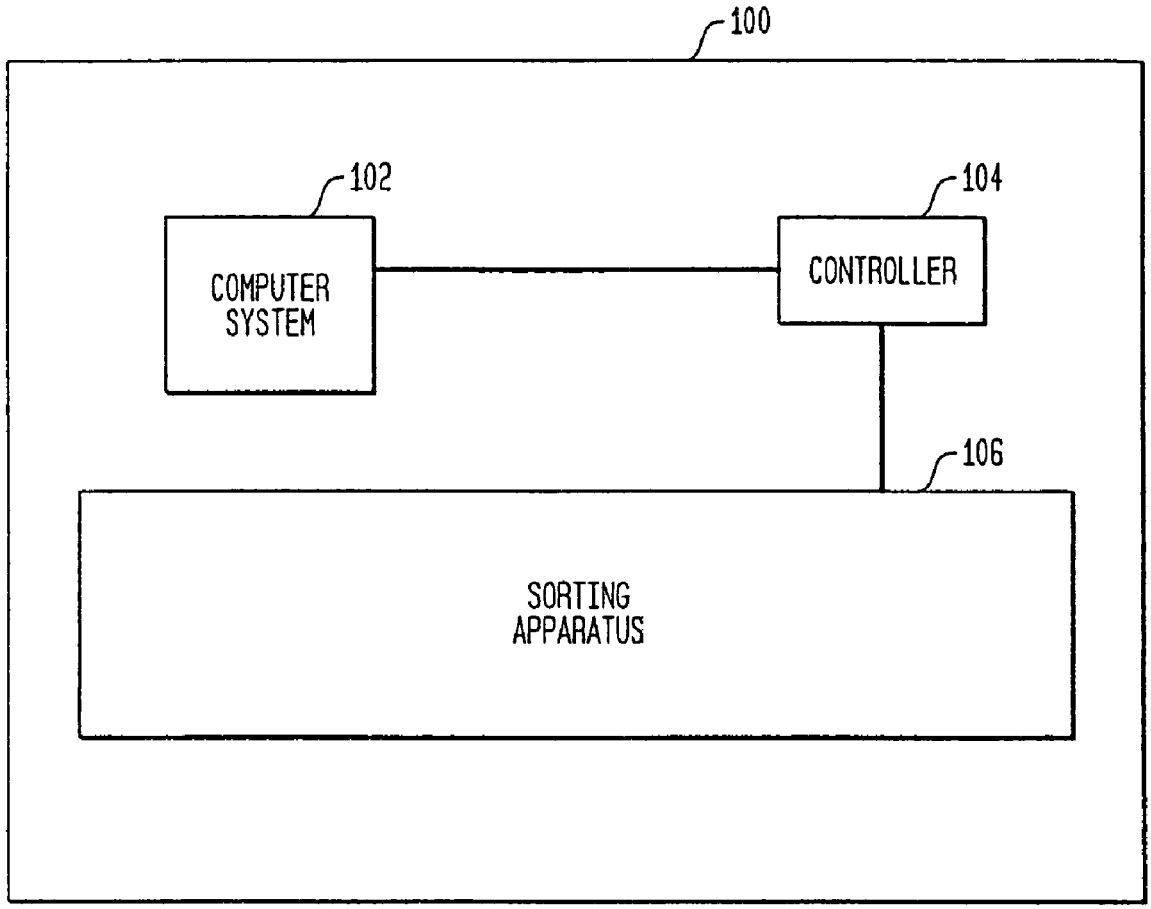
FIG. 1 is a block diagram of a high-level view of the invention.

One illustrative embodiment of the invention is shown in FIG. 1. Sorting System 100 comprises computer system 102, Controller 104, and Sorting Apparatus 106. Computer system 102, may be, for example, a general purpose computer system. Computer system 102 may include a processor connected to one or more memory devices, such as a disk drive, memory, or other device for storing data. The memory devices are typically used for storing programs and data during operation of computer system 102. Computer system 102 also includes one or more input/output devices, such as keyboard, mouse, monitor, or printing device. In addition, computer system 102 may contain one or more communication devices that connect computer system 102 to a communication network.

Computer system 102 may be a general purpose computer system that is programmable using a high-level computer programming language. Computer system 102 may also be implemented using specially programmed, special purpose hardware. In computer system 102, the processor may be a commercially available processor such as the well-known Pentium class processor available from the Intel Corporation. Many other processors are available. Such a processor usually executes an operating system which may be, for example, the Windows 95, Windows 98, Windows NT, Windows 2000 (Windows ME ) or Windows XP operating systems available from the Microsoft Corporation, MAC OS System X available from Apple Computer, the Solaris Operating System available from Sun Microsystems, or UNIX available from various sources. Many other operating systems may be used.

The memory of computer system 102 contains a computer program for implementing an algorithm for sorting items. By executing this computer program, computer system 102 may issue instructions for sorting items to Controller 104. It should also be appreciated that one or more portions of computer system 102 may be distributed to one or more computers (not shown) coupled to a communications network. These computer systems may also be general purpose computer systems.

Controller 104 receives instructions from computer system 102 and controls Sorting Apparatus 106 to operate according to these instructions. Sorting Apparatus 106 comprises a plurality of different sorting regions used for sorting items. Prior to execution of the computer program for sorting items, some sorting regions may contain items to be sorted. These regions are initial regions. Other sorting regions, which are to be used as buffer regions, or sorting spurs, are initially empty. These regions are additional regions. At least one of the additional regions is used for returning items to an operator or a downstream processing system after sorting is complete. These regions are return regions. Sorting Apparatus 106 also comprises mechanisms for moving items between positions in a sorting regions and moving items between sorting regions. The mechanism for moving items between positions in a sorting region may be, for example, a conveyor belt. The mechanism for moving items between sorting regions may be, for example, an elevator. Illustrative examples of possible configurations are shown in FIGS. 5A-5C.

Figure 5A:
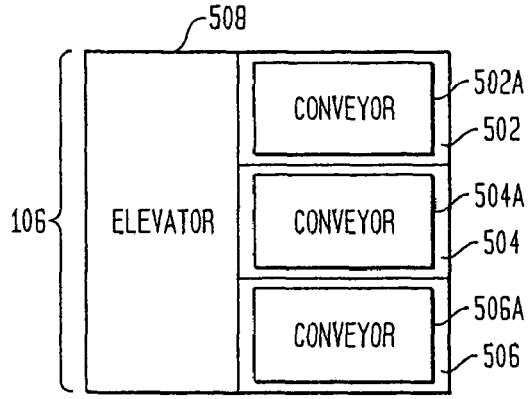
FIG. 5A is a depiction of one embodiment of a Sorting Apparatus.

FIG. 5A is an example of one arrangement of Sorting Apparatus 106. In this illustrative example, Sorting Apparatus 106 comprises three Sorting Regions 502, 504, and 506, arranged in a vertical row. However, any reasonable number of Sorting Regions may be used, depending on particular size constraints. The Sorting Regions are coupled to Elevator 508. Conveyors 502A, 504A, 506A can move items within their respective Sorting Regions and can also move items from their respective sorting regions to Elevator 508. Conveyors 502A, 504A, and 506A can also move items from Elevator 508 into their respective sorting regions. When an item is moved to Elevator 508 by a Conveyor 502A-506A, Elevator 508 can move vertically to transfer the item to another Conveyor. In this arrangement items are located linearly within the Sorting Regions 502-506, and only the item adjacent to Elevator 508 can be moved to Elevator 508. Likewise, when an item is moved to a Sorting Region from Elevator 508, it is placed in the position adjacent to Elevator 508. Elevator 508 may be capable of transporting only one item at a time or it may be capable of transferring multiple items. In the latter case, an item in a Sorting Region 502, for example, positioned adjacent to Elevator 508 may be moved to Elevator 508 via Conveyor 502A. Then, another item in Sorting Region 502 may be moved into the position adjacent to Elevator 508 by Conveyor 502A and subsequently moved to Elevator 508. Alternatively, Elevator 508 may transfer items from two different Sorting Regions. For example, Elevator 508 may contain an item from Sorting Region 502. Then, Conveyor 504A may move a second item from Sorting Region 504 to Elevator 508. Then, Elevator 508 may, for example, transfer both of these items to Sorting Region 506.

Figure 5B:
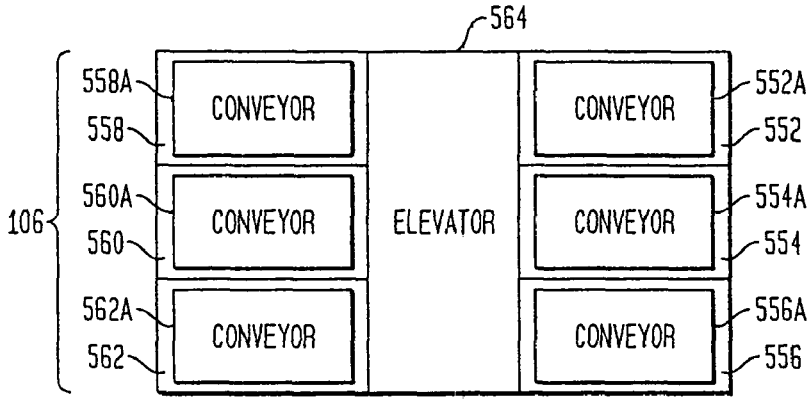
FIG. 5B is a depiction of a second embodiment of a Sorting Apparatus.

FIG. 5B is an example of another illustrative arrangement of Sorting Apparatus 106. In this example, Sorting Apparatus 106 comprises two vertical rows of Sorting Regions separated by Elevator 564. Again, three Sorting Regions are shown in each row, though any reasonable number of Sorting Regions may be used. In this arrangement, items can be moved within Sorting Regions by Conveyors 552A-562A and transferred to and from Elevator 564. Thus, an item can be moved to another Sorting Region in the same vertical row or another Sorting Region in another vertical row. Similar to the arrangement in FIG. 5A, items are arranged linearly within each Sorting Region, so only items adjacent to Elevator 564 may be moved onto Elevator 564. In this embodiment, Elevator 564 is also capable of transferring one item at a time or multiple items at a time.

Figure 5C:
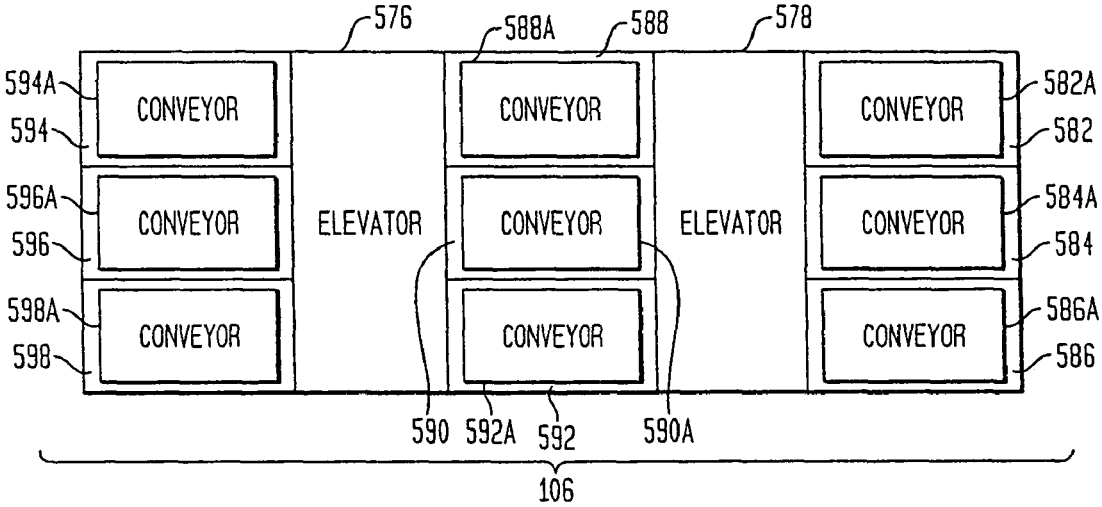
FIG. 5C is a depiction of a third embodiment of a Sorting Apparatus.

FIG. 5C is an example of another illustrative arrangement of Sorting Apparatus 106. In this example, three rows of Sorting Regions are separated by two rows of Elevators. This arrangement has the advantage that items located in Sorting Regions 588, 590, and 592 can be moved onto either Elevator 578 or Elevator 576. Various other arrangements, such as altering the number of Sorting Regions in a row, or altering the number of rows of Sorting Regions and the number of Elevators will occur readily to one skilled in the art. These and other arrangements are intended to be within the spirit and scope of the invention.

Figure 2:
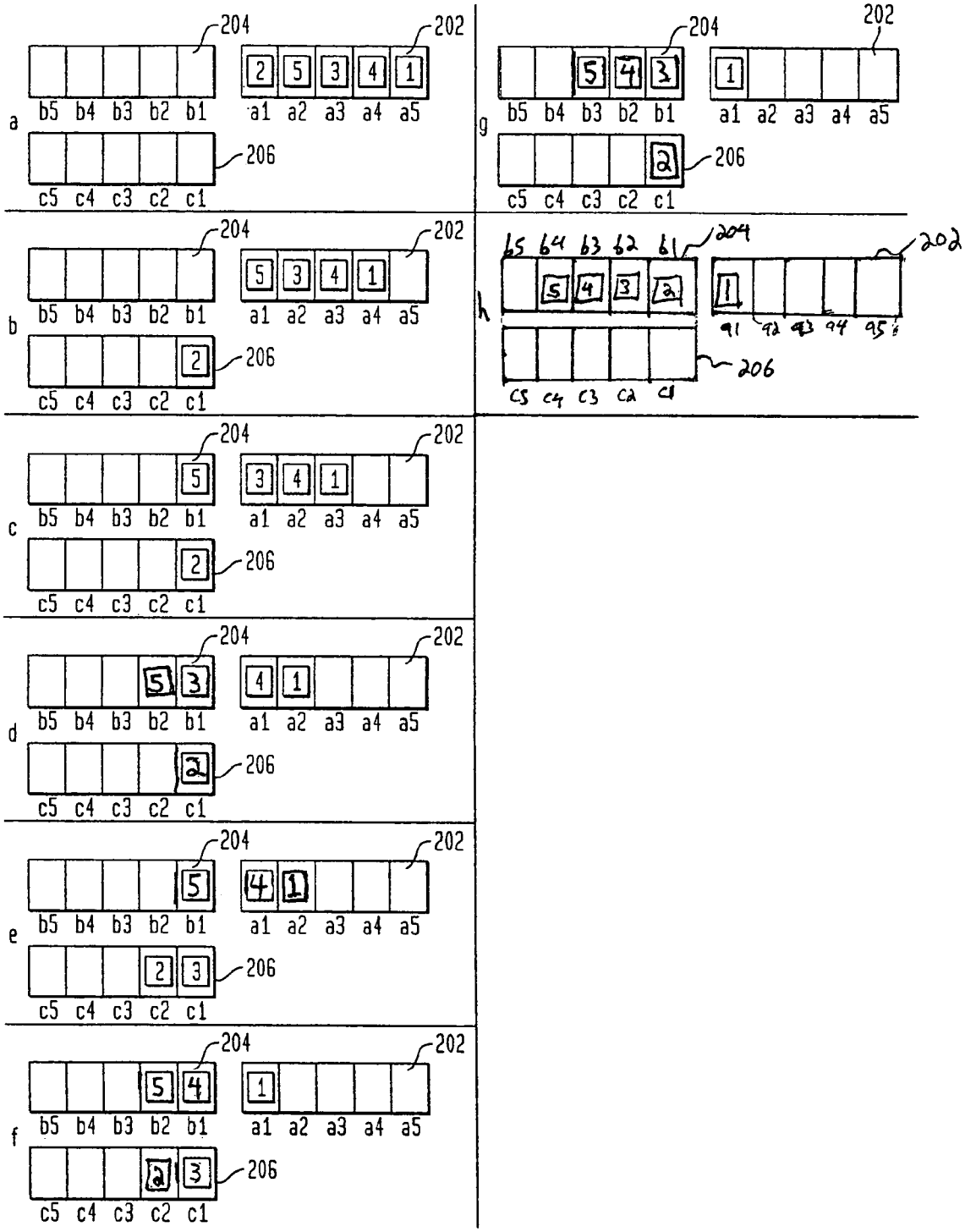
FIG. 2 is a depiction of the sorting process for one Initial Region.
Figure 3:
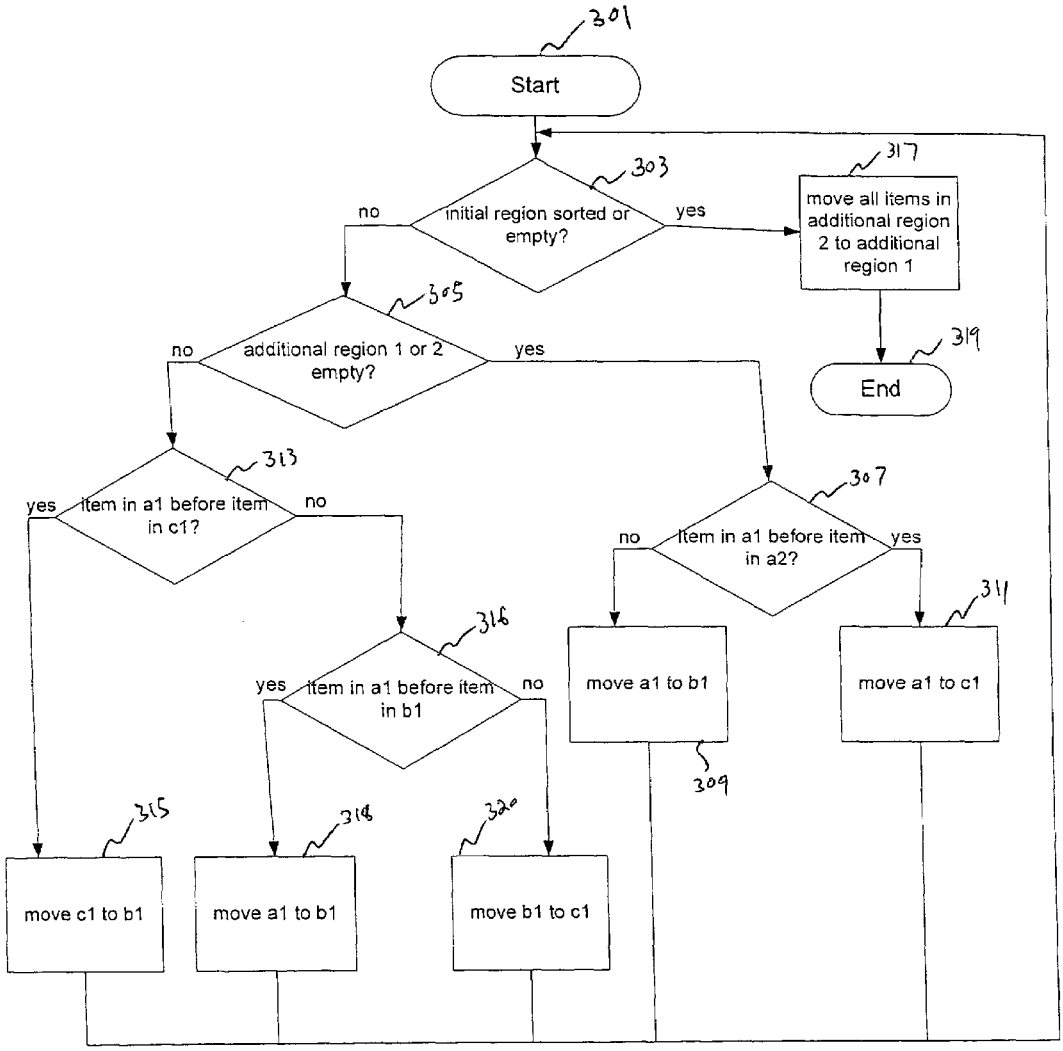
FIG. 3 is a flow chart illustrating the sorting process for one Initial Region.

An initial Sorting Region of Sorting Apparatus 106 is sorted according to the process illustrated in FIG. 3. FIG. 2 illustrates an example sort according to the process illustrated in FIG. 3. FIG. 2 shows three Sorting Regions 202, 204, and 206. Each of these Sorting Regions has a capacity of five items. The capacity of the Sorting Regions is chosen as example. The capacity of the Sorting Regions is dependent on the size of the Sorting Region and the size of the items to be sorted. Any reasonable capacity may be chosen. In this example, Sorting Region 202 has five positions for items, a1-a5. Sorting Region 204 has positions b1-b5 and Sorting Region 206 has positions c1-c5. In this example, Sorting Region 202 is an initial region while Sorting Regions 204 and 206 are additional regions. In this example, Sorting Region 204 is Additional Region 1 and Sorting Region 206 is Additional Region 2. Sorting Region 206 also serves as a Return Region. In this example, Sorting Region 202 is initially loaded with five items. As shown in step a of FIG. 2, computer system 102 (not shown) assigns a number to each item, based upon the desired sorted sequence of items. In this example, the item in position a1 is assigned the sequence number 2, the item in position a2 is assigned the sequence number 5, the item in position a3 is assigned the sequence number 3, the item in position a4 is assigned the sequence number 4, and the item in position a5 is assigned the sequence number 1. No computer-readable label is applied to the items. Computer system 102 merely stores the sequence number and location of each item in memory and updates this information as it instructs Sorting Apparatus 106 to move items. The initial sequence number and position of the items on the sorting regions may be read by computer system 102 from a previously written file. The file may be generated by another computer application or may be generated manually. The file may reside locally on storage media at computer system 102 or may be remotely accessed via a network by computer system 102. Alternatively, the information could be passed directly to the primary memory of computer system 102.

As shown at step 301 of FIG. 3, the sorting process begins. At step 303, it is determined if the initial sorting region is sorted or empty. If the initial region is sorted or empty, the process continues at step 317, where all items in Additional Region 2 are moved to Additional Region 1 and, at step 319, the process ends. However, in the example shown in FIG. 2, step a, the initial region, Sorting Region 202, is not sorted or empty, so the process continues to step 305. At step 305, if either of the Additional Regions are empty, the process continues to step 307, where it is determined if the sequence number of the item in a1 is before the sequence number of the item in a2. That is, it is determined if the item in a1 precedes the item in a2 in the sorted sequence. If the item in a1 is before the item in a2 in the sequence, the item in a1 is moved to position c1, as shown at step 311. Otherwise, the item in a1 is moved to position b1, as shown at step 309. In FIG. 2, item 2 is before item 5 in the sequence, so item 2 is moved to position c1, as shown in step b of FIG. 2. Then, all the items in the initial region are shifted over one position, to fill the spot left by item 2.

Next, the process returns to step 303. Again, since the initial region is not sorted or empty, the process continues to step 305. At step 305, Additional Region 1 is still empty, so the process continues to step 307. The item in position a1 is now item 5 and the item in position a2 is item 3. Since item 5 is after item 3 in the sequence, item 5 is moved to position b1 and all items in the initial region are again shifted to fill the empty spot, as shown in step c of FIG. 2.

Again, the process returns to step 303. Since the initial region is still not in sorted order and is not empty, the process continues to step 305. Now, neither Additional Region is empty so the process continues to step 313 where it is determined if the item in position a1 is before the item in position c1 in the sequence. In the example of FIG. 2, item 3 is located in position a1 and item 2 is located in position c1. Thus, the item in position a1 is after the item in position c1, so the process continues to step 316. At step 316, it is determined if the item in a1 is before the item in b1. In the example of FIG. 2, item 3 in position a1 is before item 5 in the sorted sequence, so the process proceeds to step 318 where the item in position a1 is moved to position b1. Thus, as shown in step d of FIG. 2, item 3 is moved from position a1 to position b1, shifting item 5 to position b2. Further, the rest of the items in initial region 202 are shifted on position over to the left.

The process then returns to step 303. The initial region is still not in sorted order and is not empty, so the process continues to step 305. Neither additional region is empty, so the process continues to step 313, where it is determined if the item in position a1 is before the item in position c1 in the sequence. In FIG. 2, step d, item 4 in position a1 is not before item 2 in position c1, so the process continues to step 316. At step 316, it is determined if the item in a1 is before the item in b1. In FIG. 2, step d, item 4 in position a1 is not before item 3 in position b1, so the process proceeds to step 320, where the item in b1 is moved to the item in c1. Thus, as shown in FIG. 2, step e, item 3 in position b1 is moved to position c1, thus moving item 2 into position c2. Item 5 in region 204 is shifted to position b1 to fill the vacancy left by item 3.

The process then returns to step 303, where again it is determined if the initial region is empty. In FIG. 2, the additional region is not sorted or empty, so the process continues to act 305 where it is again determined if either of the additional regions are empty. In FIG. 2, neither additional region is empty so the process continues to act 313, where it is determined if the item in a1 is before the item in c1. In FIG. 2, step e, item 4 in position a1 is not before item 3 in position c1 in the sorted sequence. Thus, the process continues to step 316, where it is determined if the item in a1 is before the item in b1 in the sorted sequence. In FIG. 2, step e, item 4 is before item 5 in the sorted sequence, so the process continues to step 318 where the item in a1 is moved to position b1. Thus, as shown in FIG. 2, step f, item 4 is moved from position a1 to position b1.

The process then returns to step 303. Initial region 202 is now in sorted order, as it only has one item remaining in it (i.e., item 1). Thus, the process proceeds to step 317 where all items in additional region 206 are moved to additional region 204. First, as shown at step g of FIG. 2, item 3 is moved from position c1 to position b1. Then, as shown at step h of FIG. 2, item 2 is moved from position c1 to position b1. The process ends at step 319. It should be appreciated that the sorting algorithm of FIG. 3 leaves each region (i.e., regions 202, 204, and 206) in sorted order. Thus, if desired, the items may be returned (e.g., to a return region) by moving the items from the proper region in sorted order. For example, In FIG. 2, step h, if it were desired to move the items to a return region in sorted order, item 1 from location a1 in region 202 may be first be moved to the return region, followed by item 2 from location b1 in region 203. It should be appreciated that in some embodiments of the invention the algorithm may be modified such that instead of leaving each region separately sorted (i.e., with the possibility that the items may be in different regions), the items may be placed in an overall sorted order in a single region. Thus, the intermediary sorted set is in a single region instead of several regions.

The algorithm described above is a method for sorting one Initial Region of Sorting Apparatus 106 into an intermediary sorted set. Many other algorithms or variations to this algorithm will occur readily to one skilled in the art and are intended to be within the spirit and scope of the invention. For example, the number of Additional Regions used or the number of positions within each Additional Region may be altered. Also, it is not required that one of the Additional Regions serve as a Return Region. In this case, the Additional Region does not have to be cleared to complete the sorting of the Initial Region. Additionally, the Initial Region could be cleared out at the end of the sort by moving all items from the Initial Region to an Additional Region, thus allowing the Initial Region to serve as an Additional Region when sorting other Initial Regions. Furthermore, it is also possible to carry out certain steps in the sorting algorithm in parallel. For example, while moving an item from one sorting region to another sorting region it is also possible to shift all of the items on another sorting region so that the items are adjacent to the elevator. The opportunities for parallel moves will depend on the particular sorting algorithm and sorting apparatus being used. For example, when using multiple elevators it is possible to move multiple items to separate sorting regions at substantially the same time. Consequently, it is not necessary to carry out each operation serially, as certain operations which do not affect each other may be carried out in parallel.

It should also be understood the entire sorting algorithm may be performed inside computer system 102 before any instructions are sent to Controller 104 to control Sorting Apparatus 105. Since, as mentioned above, the items are not marked with any computer-readable label, computer system 102 is able to track the location of items based on their initial position and the movement of items within and between Sorting Regions. Thus, the entire sorting algorithm may be executed within computer system 102 and the instructions for moving items and the sequence in which these instructions are issued may be stored as a result of executing the sorting algorithm. Then, these instructions may be sent to Controller 104. Alternatively, computer system 102 may send instructions to Controller 104 while executing the sorting algorithm, without having to save the instructions.

Figure 7A:
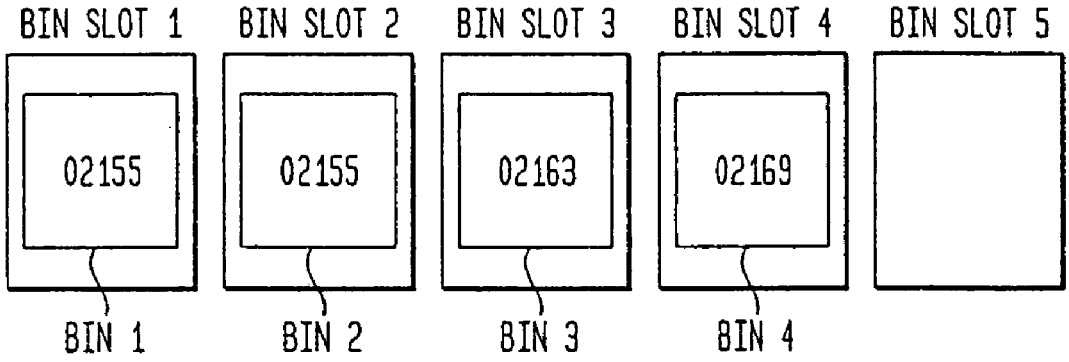
FIG. 7A is a depiction of bins prior to ejection onto Sorting Regions, according to one embodiment of the invention.
Figure 7B:
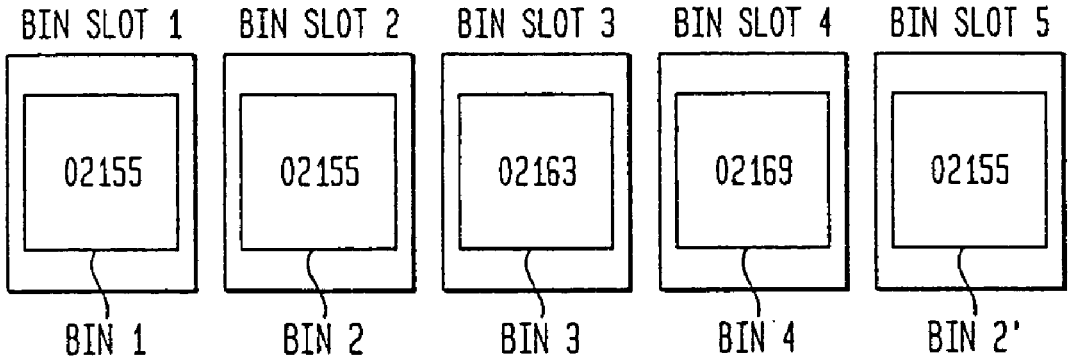
FIG. 7B is a depiction of bins prior to ejection onto Sorting Regions, according to one embodiment of the invention.

In one embodiment of the invention, Sorting Apparatus 105 is used to sort postal bins containing mail pieces. Typically, individual mail pieces are sorted into bins based upon the destination of the mail piece. After the mail pieces are sorted into the bins, the bins themselves must be sorted. The initial sequence number and position of the bins on the sorting apparatus may be determined by the process of sorting mail pieces into the bins and subsequently saved for use by the bin sorting process. Bins may be placed in bin slots adjacent to the Initial Regions of Sorting Apparatus 105. Individual mail pieces may be sorted into the bins while they are in the bin slots. Once the mail is sorted into the appropriate bins, the bins are ejected onto the Initial Regions of Sorting Apparatus 105. In one arrangement, bins may be placed in a random order in the bin slots. In another arrangement, bins may be placed in the desired sorted sequence in the bin slots. However, since it is difficult to predict how much mail is going to a given location, one cannot predict how many bins will be needed for a given destination. For example, referring to FIG. 7A, Bins 1-4 are placed in Bin Slots 1-4 in the desired sorted sequence, based on the zipcode to which the mail in those bins is addressed. Thus, Bins 1 and 2 will contain mail going to zipcode 02155, Bin 3 will contain mail going to zipcode 02163, and Bin 4 will contain mail going to zipcode 02169. Individual mail pieces are sorted into the bins based on these zipcodes. However, during sorting all the mail going to zipcode 02155 may not fit into Bins 1 and 2. Thus, an additional bin is needed for the overflow. This bin cannot be placed in the desired sorted sequence because there is no empty bin slot between Bin 2 and Bin 3. Thus, this overflow bin, Bin 2' must be placed in the next available bin slot, which is Bin Slot 5, as shown in FIG. 7B. Consequently, these bins will not be in the desired sorted sequence when ejected onto an Initial Region because Bin 2' will be out of order.

Although it is possible to leave certain bin slots empty in expectation of overflow mail, it is very difficult to predict the exact location in which an extra bin will be needed. For example, referring to FIG. 7A, one might initially leave Bin Slot 4 empty, in expectation of overflow mail for Bin 3. Thus, Bin 4 is initially located in Bin Slot 5. However, during the actual sort Bin 2 has overflow mail while Bin 3 does not. Thus, the overflow mail would be sorted into a bin in Bin Slot 4. As can be seen, the number of operations required to complete the sort may be improved by leaving empty bin slots (since the overflow bins will be placed closer to their proper place in the sequence), however, it still may be necessary to sort the bins.

Figure 6A:
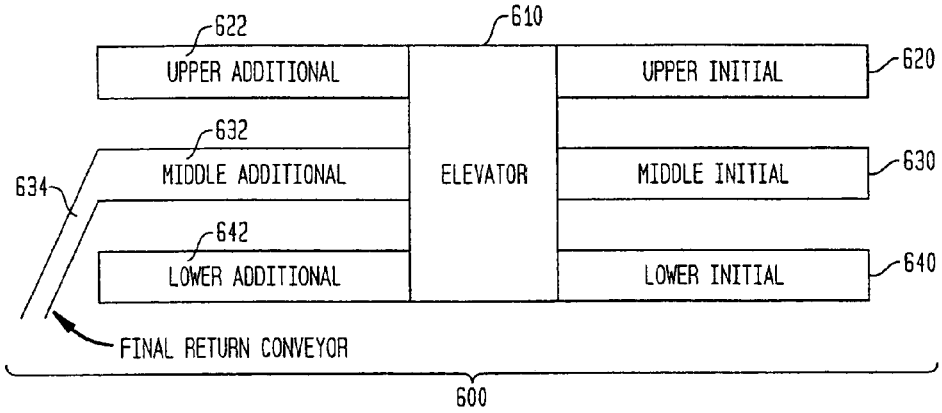
FIG. 6A is a depiction of an embodiment of the invention used for sorting postal bins.

An example of Sorting Apparatus 105 and process for sorting these bins and overflow bins is illustrated in FIGS. 6A-6I. In FIG. 6A, Sorting Apparatus 600 comprises three Initial Regions, Upper Initial Region 620, Middle Initial Region 630, and Lower Initial Region 640, located on one side of Elevator 610. Sorting Apparatus 600 further comprises three Additional Regions, Upper Additional Region 622, Middle Additional Region 632, and Lower Additional Region 642, located on the opposite side of Elevator 610. Middle Additional 632 also serves as a Return Region, to which is attached Final Return Conveyor 634, which is used to return bins serially, in the sorted sequence.

Figure 6B:
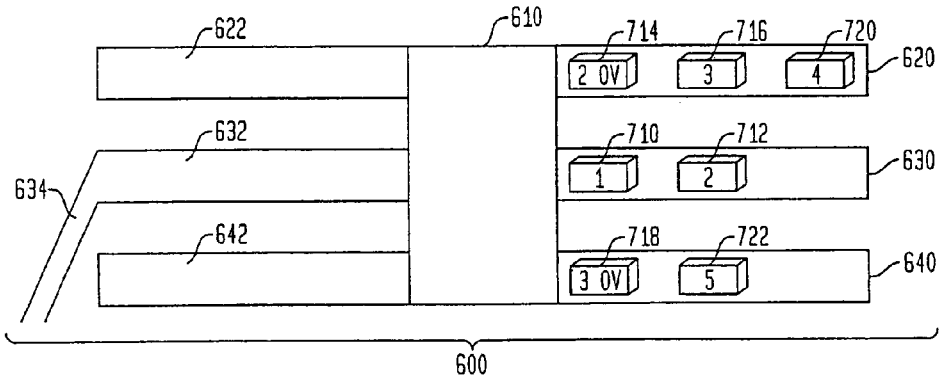
FIG. 6B is a depiction of the sorting process for the embodiment shown in FIG. 6A, according to the process illustrated in the flowchart of FIG. 4.

After individual mail items are sorted into bins, the bins are ejected onto the Initial Regions 620, 630, and 640. As shown in FIG. 6B, Bins 714, 716, and 720 are ejected onto Upper Initial Region 620, Bins 710 and 712 are ejected onto Middle Initial Region 630, and Bins 718 and 722 are ejected onto Lower Initial Region 640. Each bin has a sequence number indicating its order in the sorted sequence. Bin 710 is the first bin in the sequence, indicated by the number 1. Bin 714 is an overflow bin of Bin 712, and thus belongs directly after Bin 712 in the sorted sequence. Similarly, Bin 718 is an overflow bin of Bin 716, and directly follows Bin 716 in the sorted sequence.

Figure 4:
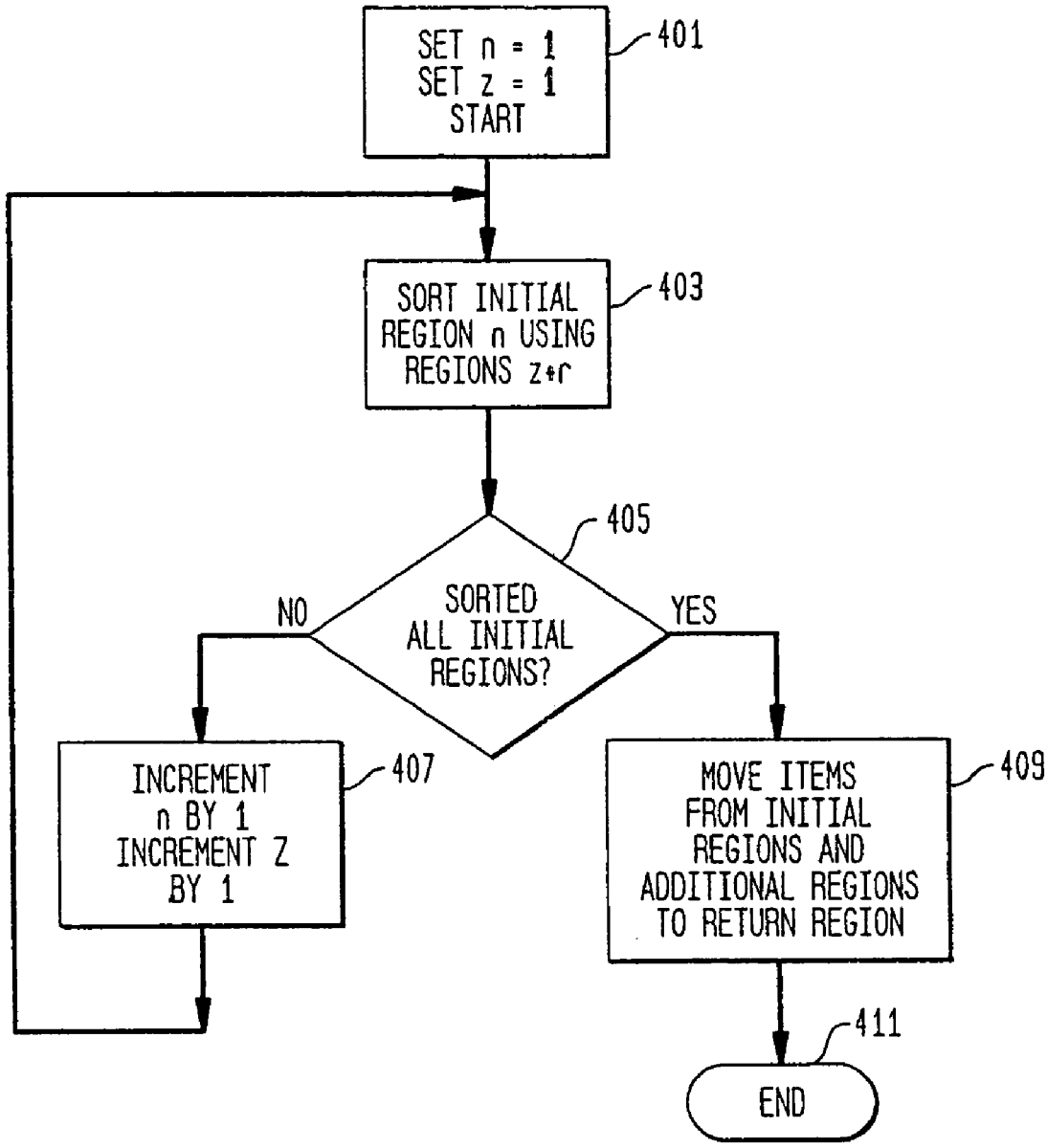
FIG. 4 is a flow chart illustrating a generalized sorting process for any Sorting Apparatus.
Figure 6C:
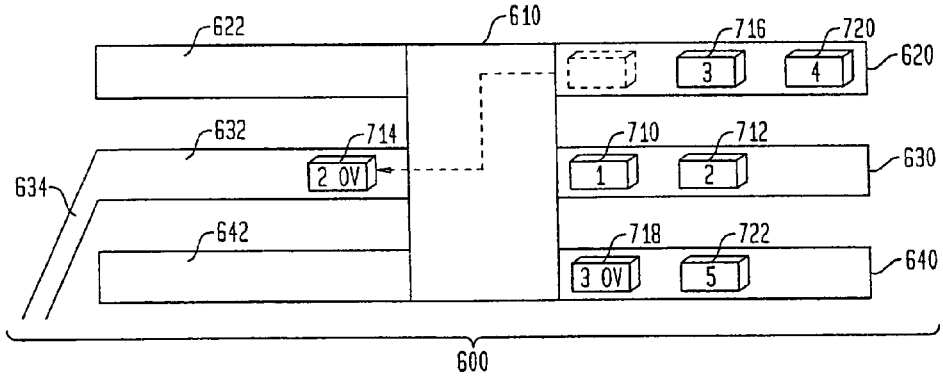
FIG. 6C is a continuation of the depiction of the sorting process shown in FIG. 6B, according to the flowchart in FIG. 4.
Figure 6D:
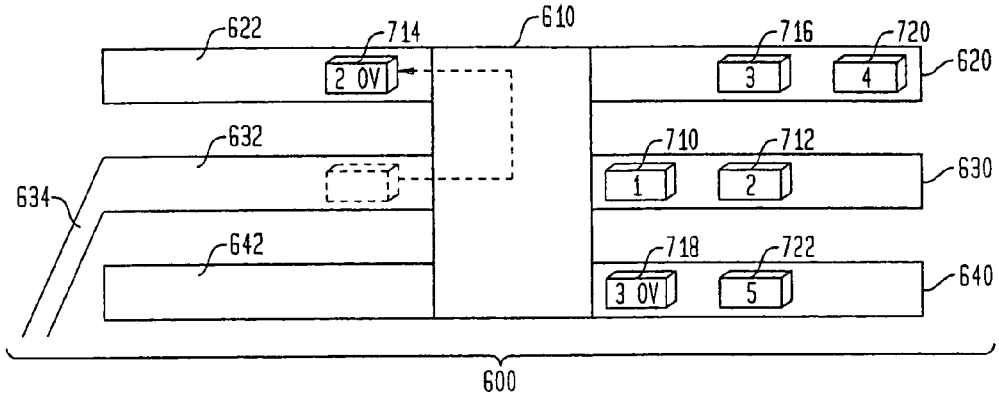
FIG. 6D is a continuation of the depiction of the sorting process of FIG. 6C, according to the flowchart in FIG. 4.
Figure 6E:
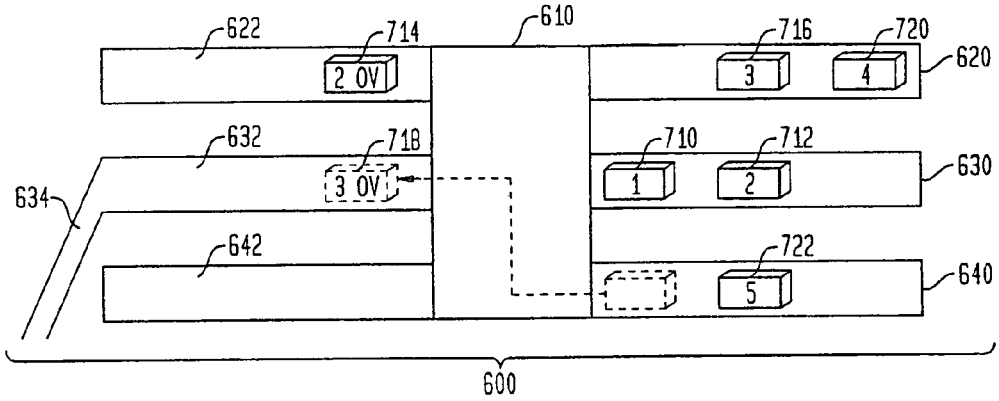
FIG. 6E is a continuation of the depiction of the sorting process of FIG. 6D, according to the flowchart in FIG. 4.
Figure 6F:
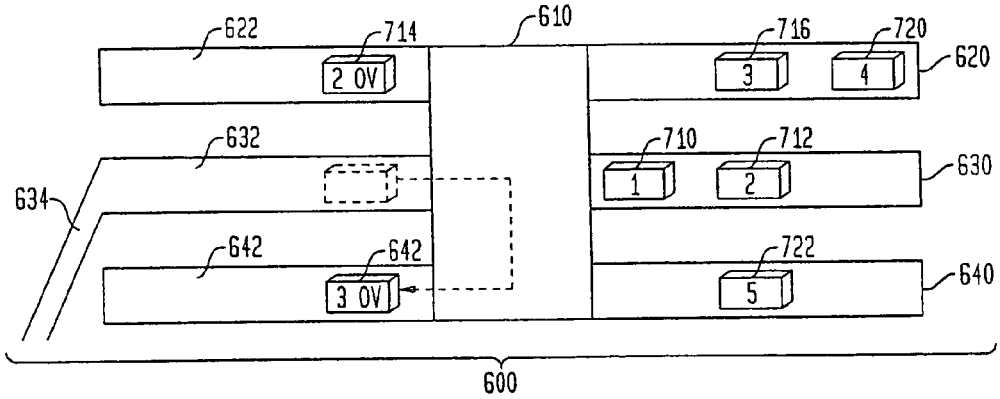
FIG. 6F is a continuation of the depiction of the sorting process of FIG. 6E, according to the flowchart in FIG. 4.
Figure 6G:
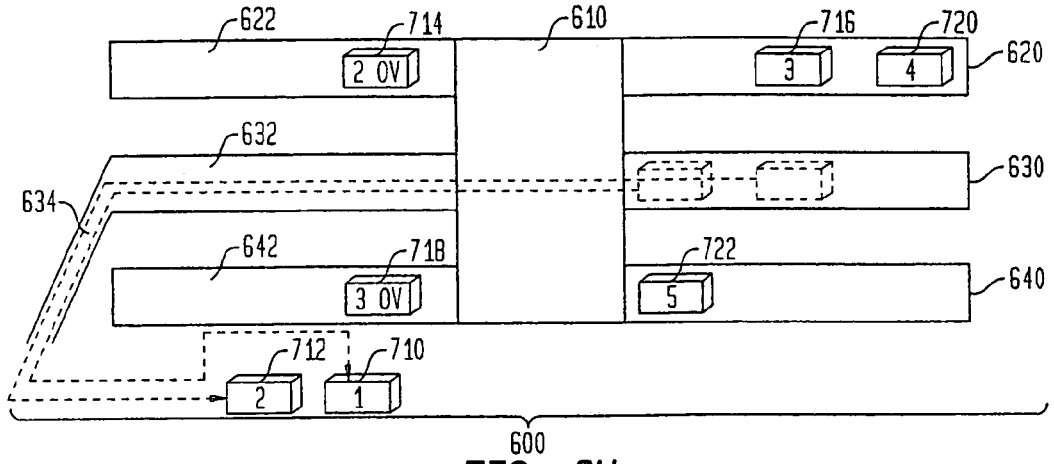
FIG. 6G is a continuation of the depiction of the sorting process of FIG. 6F, according to the flowchart in FIG. 4.
Figure 6H:
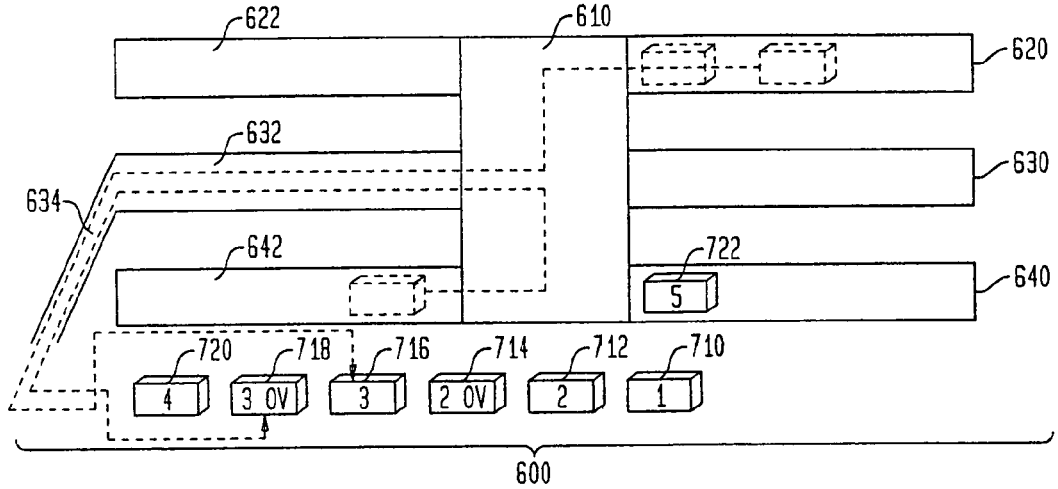
FIG. 6H is a continuation of the depiction of the sorting process of FIG. 6G, according to the flowchart in FIG. 4.
Figure 6I:
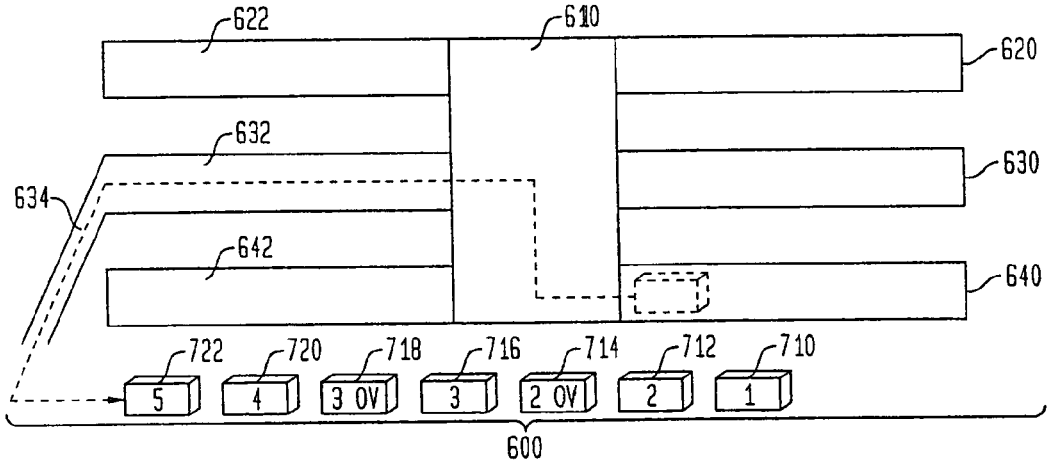
FIG. 6I is a continuation of the depiction of the sorting process of FIG. 6H, according to the flowchart in FIG. 4.

Bins 710-722 may be sorted according to the process illustrated in FIG. 4. At step 401, the process begins. In this example, n represents the Initial Region being sorted and z represents the Additional Region being used as buffer space for the sorting process. At step 403, the current Initial Region is sorted. Each Initial Region may be sorted into an intermediary sorted set, for example, according to the process described above and illustrated in FIGS. 2 and 3. In this example, Upper Initial Region 620 is sorted first using Upper Additional Region 622 and the Return Region. First, Bin 714 is moved from Upper Initial Region 620 to the Return Region, as shown in FIG. 6C. Now, Upper Initial Region is in sorted order and Additional Region 632 is in sorted order, so bin 714 is moved to Upper Additional Region 622, as shown in FIG. 6D. The process continues to step 405. All Initial Regions have not yet been sorted, so the process returns to step 403 where the next Initial Region is sorted. In this example, since Middle Initial Region 630 is already in sorted order, it does not need to be sorted. Again, the process returns to step 403 where the next Initial Region is sorted. In this example, the next Initial Region is Lower Initial Region 640, so Bin 718 is moved to the Return Region, as shown in FIG. 6E. Now Lower Initial Region is in sorted order and Middle Additional Region 632 is in sorted order, so Bin 718 is moved to Lower Additional Region 642 as shown in FIG. 6F. The process then continues to step 405. Since all Initial Regions have now been sorted, The process continues to step 409. Now, all items may be may be from the intermediary sorted sets in the Sorting Regions to the Return Region, and sent down Final Return Conveyor 634. As shown in FIG. 6G, Bins 1 and 2 are moved from Middle Initial Region 630 to the Return Region and then to the Final Return Conveyor. Next, the Bin 714 is moved to the Return Region followed by Bins 716, 718, and 720, as shown in FIG. 6H. Finally, Bin 722 is moved from the Lower Initial Region to the Return Region as shown in FIG. 6I. Now, all items haven returned serially in the desired sorted sequence. Thus, the process ends at step 411.

After each bin is returned using Final Return Conveyor 634, a sheet of paper or other identifier may be placed with each bin identifying its contents. This identifier may be human-readable or computer-readable, but is not used during the sorting the process. The identifier is used simply to identify the contents of each bin and is easily removed and separated from the bin to facilitate bin reuse.

The present invention is not limited to the apparatus and method described with respect to FIG. 4 and FIGS. 6A-6I. Other embodiments will occur readily to one skilled in the art and are intended to be within the spirit and scope of the present invention. For example, many other arrangements of the Sorting Apparatus 105 are possible, including altering the number of Initial and Additional Regions and altering the location of the Initial and Additional Regions. Additionally, the bins need not be sorted based on zipcode. Any criteria for determining the sorted sequence may be used. Also, the present invention need not be limited to sorting postal bins, many other types of items could be sorted. Moreover, the sorting process may be set up such that the sorting order of the items being sorted changes during the progress of the sort itself. For example, the first n items may be sorted using one sorted order and a next portion of items may be sorted using a different sorting order.

Not all items located on the Sorting Apparatus need be sorted. For example, if Sorting Apparatus 105 is used to sort bins full of mail items, wherein some bins contain domestic mail and others contain foreign mail, Sorting Apparatus 105 may be used to sort and return only the bins containing domestic mail, while the bins containing foreign mail may be left on Sorting Apparatus 105.

The invention is not limited by the embodiments described above which are presented as illustrations only, and can be modified and augmented various ways within the scope of protection defined by the appended claims or as contemplated by one of ordinary skill in the art.

What is claimed is:

1. A method for sorting a plurality of items, to each of which a sequence number is assigned, into a predetermined sorted sequence using a plurality of sorting regions, including for each sort, at least one initial sorting regions, and least two additional sorting regions, at least one of the additional sorting regions functioning as a return region, the items being initially located, in an unsorted order, in the at least two initial sorting regions, the method comprising the acts of:

sorting the items in each at least one initial sorting regions into at least one intermediary sorted set, in which the items are in a sorted order, by moving at least some of the items in the at least one initial sorting regions between the at least one initial sorting region and at least two of the additional sorting regions, such that two items from different initial sorting regions are sorted into the same intermediary sorted set, and by moving at least some of the items between positions in the at least two additional sorting regions; and sorting the items within each intermediary sorted set by moving at least some of the items to the return region in substantially the predetermined sorted sequence.

2. The method of claim 1, further comprising the act of using a computer to track the location of each of the plurality of items.

3. The method of claim 1, wherein the items are sorted in a single pass.

4. The method of claim 1, further comprising the act of conveying items from at least one of the return regions serially and in the predetermined sorted sequence.

5. The method of claim 1, further comprising the act of placing an identifier with each of the plurality of items.

6. The method of claim 5, further comprising the act of checking the identifier to ensure that the order of the items substantially matches the predetermined sorted sequence.

7. The method of claim 1, wherein the items are positioned linearly in the sorting regions.

8. The method of claim 1, wherein a computer is used to control the movement and positioning of the items according to a predetermined algorithm.

9. An apparatus for sorting a plurality of postal bins comprising:

a plurality of sorting regions, wherein the plurality of sorting regions comprise for each sorting at least two initial regions in which postal bins are initially located in an unsorted order, and at least two additional sorting regions, at least one of the additional sorting regions functioning as a return region in which postal bins are located after completion of sorting;

a first mechanism for physically moving at least one item between at least two selected sorting regions, where the first mechanism is configured to move two postal bins initially located in different initial regions into the same additional region;

a second mechanism for physically moving at least one item between positions within each sorting region;

a postal bin location tracking mechanism; and controls operative for controlling the first and second mechanisms to move the postal bins into a predetermined sorted sequence by sorting the postal bins in each of the at least two initial sorting regions into at least one intermediary sorted set, in which the postal bins are in a sorted order, by moving postal bins in at least one of the initial sorting regions between the at least one initial sorting region and at least two of the additional sorting regions, such that two postal bins from different initial sorting regions are sorted into the same intermediary sorted set, and sorting the postal bins within each of the at least one intermediary sorted sets by moving at least some of the postal bins to the return region in substantially the predetermined sorted sequence.

10. The apparatus of claim 9, wherein at least some of the sorting regions are located one under another and wherein the first mechanism includes an elevator.

11. The apparatus of claim 9, wherein the second mechanism is a conveyor.

12. The apparatus of claim 9, wherein the controls include a processor running a subroutine for issuing instructions according to a selected item sorting algorithm.

* * * * *